US008348637B2

(12) United States Patent
Heitzler et al.

(10) Patent No.: US 8,348,637 B2
(45) Date of Patent: Jan. 8, 2013

(54) GEAR PUMP AND METHOD OF DELIVERING FLUID USING SUCH A PUMP

(75) Inventors: Jean-Claude Heitzler, Horbourg Wihr (FR); Christian Muller, Strasbourg (FR)

(73) Assignee: Cooltech Applications S.A.S., Holtzheim (FR)

( * ) Notice: Subject to any disclaimer, the term of this patent is extended or adjusted under 35 U.S.C. 154(b) by 288 days.

(21) Appl. No.: 12/670,933

(22) PCT Filed: Jun. 23, 2008

(86) PCT No.: PCT/FR2008/000879

§ 371 (c)(1), (2), (4) Date: Jan. 27, 2010

(87) PCT Pub. No.: WO2009/024663

PCT Pub. Date: Feb. 26, 2009

(65) Prior Publication Data

US 2010/0200072 A1 Aug. 12, 2010

(30) Foreign Application Priority Data

Jul. 30, 2007 (FR) ..... 07 05544

(51) Int. Cl.
*F01C 1/18* (2006.01)

(52) U.S. Cl. ..... 417/410.3; 417/410.4; 418/15; 418/183; 418/205; 418/206.1; 418/79

(58) Field of Classification Search ..... 417/410.3, 417/410.4; 418/15, 183, 205, 206.1, 206.4, 418/79, 75–77, 132, 131
See application file for complete search history.

(56) References Cited

U.S. PATENT DOCUMENTS

| | | | | |
|---|---|---|---|---|
| 2,400,485 | A * | 5/1946 | Cardille | 418/15 |
| 3,029,739 | A * | 4/1962 | Nagely | 418/73 |
| 3,234,888 | A * | 2/1966 | Wise et al. | 418/196 |
| 3,854,492 | A * | 12/1974 | Kita | 137/99 |
| 3,857,461 | A * | 12/1974 | Schmitt | 184/6.2 |
| 5,004,407 | A * | 4/1991 | Hutchison | 418/1 |
| 7,536,866 | B2 * | 5/2009 | Kobayashi et al. | 62/3.1 |

FOREIGN PATENT DOCUMENTS

| | | |
|---|---|---|
| DE | 31 370 01 A1 | 3/1983 |
| DE | 19 915 319 A1 | 3/2000 |
| GB | 1055850 | 1/1967 |

* cited by examiner

*Primary Examiner* — Charles Freay
*Assistant Examiner* — Christopher Bobish
(74) *Attorney, Agent, or Firm* — Davis & Bujold, PLLC

(57) ABSTRACT

A gear pump capable of alternately distributing a fluid in two distinct utilization circuits without the need for a switch. The gear pump (1) comprises two fluid outlet ports (5, 6) connected to two fluid utilization circuits and linked to the discharge chamber (C) of the pump via an integrated commutation (7). These commutation (7) comprise two distribution circuits (50, 60), located in a fixed support plate (70), and two buffer channels (30, 40), located in the rotary toothed wheels (3), arranged so as to alternately open and close the distribution circuits according to a commutation cycle that approximately corresponds to the rotation of the toothed wheels over half a revolution.

13 Claims, 6 Drawing Sheets

GEAR PUMP AND METHOD OF DELIVERING FLUID USING SUCH A PUMP

This application is a national stage completion of PCT/EP2008/000879 filed Jun. 23, 2008 which claim priority from French application Ser. No. 07/05544 filed Jul. 30, 2007.

TECHNICAL SCOPE

The present invention concerns a gear pump comprising a pump housing in which at least two toothed wheels are housed, with parallel axes, meshed and delimiting a suction chamber on one side of the meshing zone and a discharge chamber on the other side of the meshing zone, said housing comprising at least one fluid inlet port connected to at least one fluid supply circuit and linked to said suction chamber, and at least one fluid outlet port connected to at least one a fluid utilization circuit and linked to the discharge chamber.

The invention also concerns a fluid distribution process in at least two utilization circuits based on at least one supply circuit.

PRIOR TECHNIQUE

Gear pump technology is well known and recommended when one requires a high degree of accuracy in the quantity of distributed fluid and/or high pressure. This technology as well as the other known pump types supply a fluid to a single utilization circuit, and comprise one inlet port and one outlet port for that purpose. To supply a fluid to two distinct utilization circuits, one uses either two individual pumps, or one twin-housing pump which is equivalent to two pumps placed within the same pump housing.

Similarly, no known pump is designed to circulate a fluid alternately within two distinct utilization circuits. In this particular case, one generally uses a single pump associated with a switch to circulate the fluid from one circuit to the other according to a predetermined alternate cycle. The switches commonly used are three-way valves specifically controlled by an energy source external to the heat generator, which can be electric or pneumatic. The presence of these switches restricts the frequency of the fluid's alternate circulation cycle. And yet, when considering specific applications, such as for example a heat generator with magneto-caloric material, one seeks to increase the commutation frequency, in particular to improve the thermal efficiency. The presence of these switches is therefore detrimental.

DESCRIPTION OF THE INVENTION

The present invention aims to resolve this problem by suggesting a new generation of gear pumps capable of alternately distributing a fluid in two distinct utilization circuits without the need for a switch.

For that purpose, the invention concerns a gear pump of the kind mentioned in the preamble, characterized in that said pump comprises at least two fluid outlet ports connected to at least two fluid utilization circuits, these outlet ports being linked to said discharge chamber via integrated means of commutation arranged so as to alternately distribute this fluid in said utilization circuits according to a predetermined commutation cycle, which can be approximately equal to the rotation of the toothed wheels during a maximum of half a revolution.

In a preferred embodiment, the means of commutation comprise a support plate that is plane-mounted on the toothed wheels within the housing, with the support plate comprising at least two distribution circuits and the toothed wheels each comprising at least one buffer channel, said buffer channels being arranged so as to alternately link up said distribution circuits with the discharge chamber and the outlet ports while the toothed wheels are rotating.

The distribution circuits and buffer channels can be formed by hollows respectively located on the support plate and the toothed wheels.

The buffer channels advantageously comprise at least one angular sector centred on the axis of rotation of each toothed wheel, and offset one from another by the value of said angular sector. In the preferred embodiment, the angular sectors are equal to 180° at the most and offset one from another by 180°.

Preferably, each buffer channel comprises an upstream point merged with the axis of rotation of the toothed wheel and a downstream point located within the angular sector.

In the preferred embodiment, each distribution circuit comprises an upstream channel arranged so as to link up the discharge chamber with the upstream point of its corresponding buffer channel, and a downstream channel arranged so as to link up the downstream point of the buffer channel with its corresponding outlet port, when the inlet port of the said downstream channel is located opposite the said buffer channel.

The outlet port of the upstream channel and the inlet port of the downstream channel are advantageously separated by an interval approximately equal to the radius of the buffer channel's angular sector, and the upstream channels of the distribution circuit communicate via the same inlet connected to the discharge chamber.

For this same purpose, the invention concerns a fluid distribution process of the kind mentioned in the preamble, characterized in that at least one gear pump as defined above is used, this pump comprising integrated means of commutation arranged so as to distribute said fluid alternately in the utilization circuits according to a predetermined commutation cycle.

BRIEF DESCRIPTION OF THE DRAWINGS

The present invention and its advantages will be better revealed in the following description of an embodiment given as a non limiting example, in reference to the drawings in appendix, in which.

ILLUSTRATIONS OF THE INVENTION AND BEST WAY TO EXECUTE IT

Figure 1:
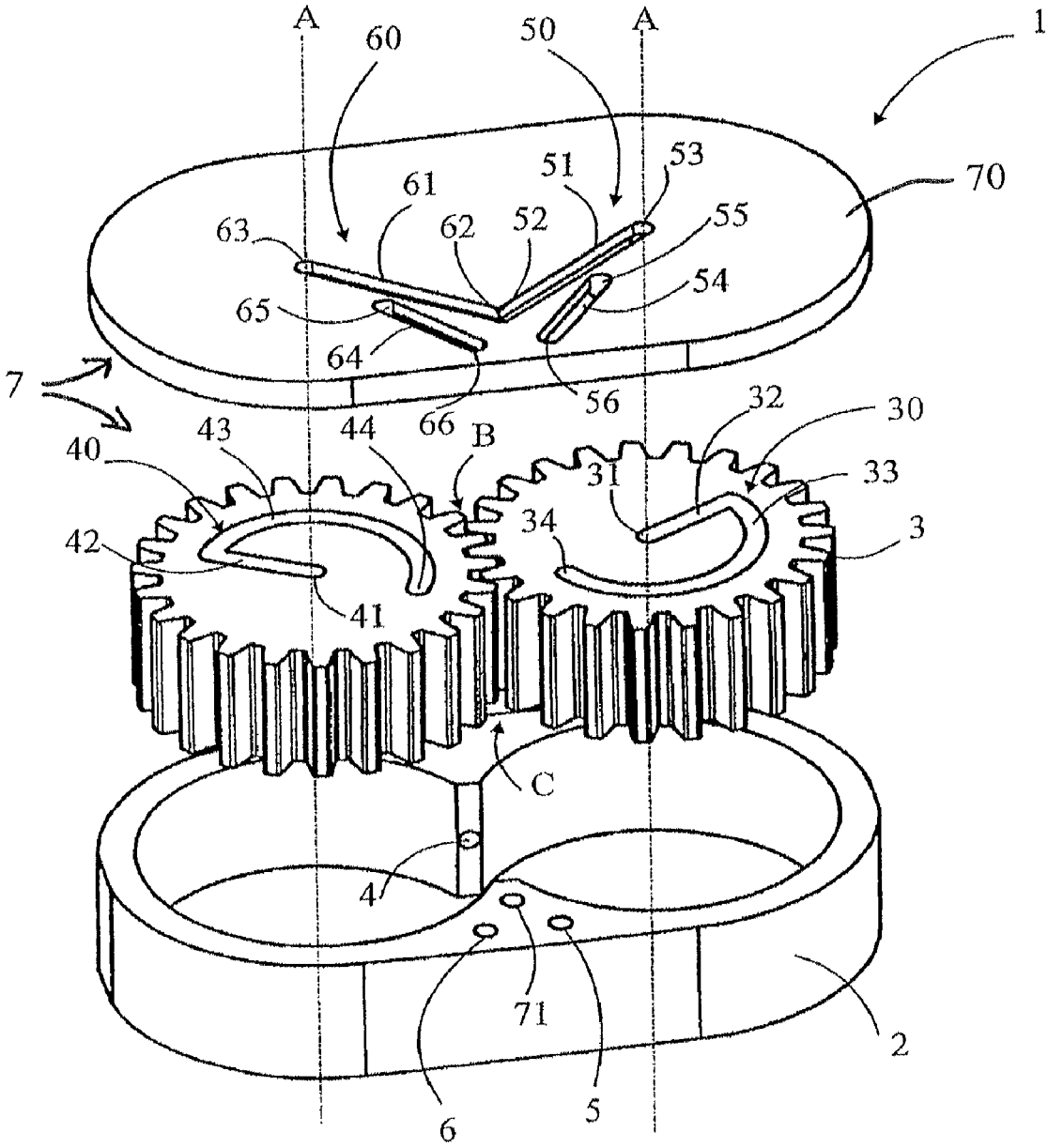
FIG. 1 is an exploded view of a gear pump according to the invention.

In reference to FIGS. 1 and 2, gear pump 1 according to the invention comprises a pump housing 2 in which two identical, meshed toothed wheels 3 with parallel axes A are housed, which delimit on one side of the meshing zone a suction chamber B and on the other side of the meshing zone a discharge chamber C, for the purpose of distributing or circulating a fluid which is a liquid fluid in this case. At least one of the toothed wheels 3 is rotated by an actuator (not illustrated), such as an electric motor or similar, while the other toothed wheel 3 is automatically driven by the driving toothed wheel at the same speed. Since the gear pumps are known, the description of the actual pump will not be detailed.

This pump 1 comprises one fluid inlet port 4, designed to be connected to a supply circuit (not illustrated), this inlet port 4 being located in the housing 2 and emerging in the suction chamber B. Unlike traditional pumps, pump 1 of the invention comprises two fluid outlet ports 5, 6 designed to be connected to two utilization circuits (not illustrated). These outlet ports 5, 6 are located in the housing 2 and communicate with the discharge chamber C via integrated means of commutation 7, arranged so as to alternately distribute the fluid coming out of pump 1 in said utilization circuits according to a predetermined commutation cycle.

The number of inlet ports 4 can be higher than one if pump 1 is connected to several supply circuits that delivers various fluids alternately or a mixture of several fluids. Similarly, the number of outlet ports 5, 6 can be higher than two if pump 1 is connected to several parallel utilization circuits. Lastly, the number of toothed wheels 3 can be higher than two, meshed with one another to form a gear train coupled to a single actuator, to distribute one or several fluids in parallel circuits. This pump 1 can also be a staged or twin-housing pump. Thus the example of pump 1 illustrated in FIGS. 1 and 2 is not limiting.

The means of commutation 7 comprise a support plate 70 for the fluid, plane-mounted in the housing 2 on the toothed wheels 3 and under the pump cover (not illustrated). The connection between the support plate 70 and the housing 2 is made tight by any tightness means (not illustrated). This support plate 70 comprises distribution circuits 50, 60, in numbers equal to that of the outlet ports 5, 6, namely two distribution circuits in the illustrated example. These distribution circuits 50, 60 are respectively linked on the one hand with the discharge chamber C via a port 71 located in the housing 2 and on the other hand with the outlet ports 5, 6. In the illustrated example, the distribution circuits are made as crossing hollows obtained using a machining, moulding or similar process, and require to be sealed on the opposite side of the toothed wheels 3 thanks to a tight cover (not illustrated). They can also be made as blind hollows. In this case, the support plate 70 forms the cover of the pump housing 2.

The means of commutation 7 also comprise buffer channels 30, 40, two in the example illustrated, respectively located in the toothed wheels 3, and more particularly in the face of these toothed wheels 3 aligned with the support plate 70, so that they can communicate with the distribution circuits 50, 60, when the support plate 70 is mounted on the housing 2. They are made as blind hollows obtained using a machining, moulding or similar process. Each buffer channel 30, 40 starts at an upstream point 31, 41 merged with the axis of rotation A of the toothed wheel 3, continues with a straight sector 32, 42 that defines a radius R, prolonged by an angular sector 33, 43 of radius R centred on the axis of rotation A, and ends at a downstream point 34, 44. In the illustrated example, the angular sector 33, 43 of the buffer channels 30, 40 extends across approximately 180°, so that, over a full revolution of the toothed wheels 3, the buffer channels 30, 40 open and close the distribution circuits 50, 60 in a cycle of half a revolution. Moreover, these two buffer channels 30, 40 are offset by 180°, so that they operate alternately on each cycle. Evidently, the shape of the buffer channels 30, 40 and the angular value of sector 33, 44 can vary according to the flow rate of fluid to be distributed during each cycle. The cooperation between the distribution circuits 50, 60 located in the fixed support plate 70 and the buffer channels 30, 40 located in the revolving toothed wheels 3 allows the commutation function between two fluid circuits to be created, this function being fully integrated in pump 1.

The distribution circuits 50, 60 located in the support plate 70 comprise an upstream channel 51, 61, the fluid inlets 52, 62 of which are merged and aligned with the port 71 supplied by the discharge chamber C, and the fluid outlets 53, 63 of which are aligned with the upstream point 31, 41 of their corresponding buffer channel 30, 40. Thus, the upstream channels 51, 61 and the buffer channels 30, 40 are constantly supplied in fluid. They also comprise a downstream channel 54, 64, the fluid inlets 55, 65 of which are aligned with the downstream point 34, 44 of their corresponding buffer channel 30, 40 over half a revolution of the toothed wheels 3, and the fluid outlet 56, 66 of which is aligned with its corresponding outlet port 5, 6. This downstream channel 54, 64 is consequently supplied in fluid over half a revolution of the toothed wheels 3 and not supplied with fluid over the following half revolution. For this purpose, the outlet 53, 63 of the upstream channels 51, 61 and the inlet 55, 65 of the downstream channels 54, 64 are separated by an interval approximately equal to the radius of the angular sector 33, 43 of the buffer channels 30, 40. Evidently, this alternate mode of distribution over each half revolution of the toothed wheels 3, with no recovery period, can be modified at will by changing the drawing of channels 30, 40, 54, 64 so as to obtain an alternate distribution, over different portions of revolution of the toothed wheels 3, with or without a recovery period, in two or more utilization circuits.

Figure 2A:
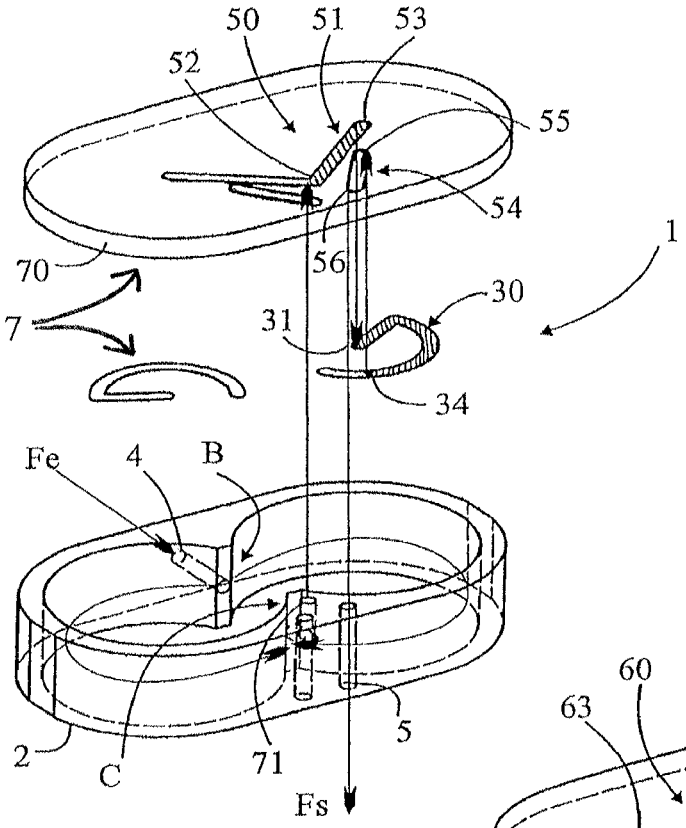
FIGS. 2A and 2B are partial views of the pump from FIG. 1, respectively illustrating each fluid distribution system.
Figure 2B:
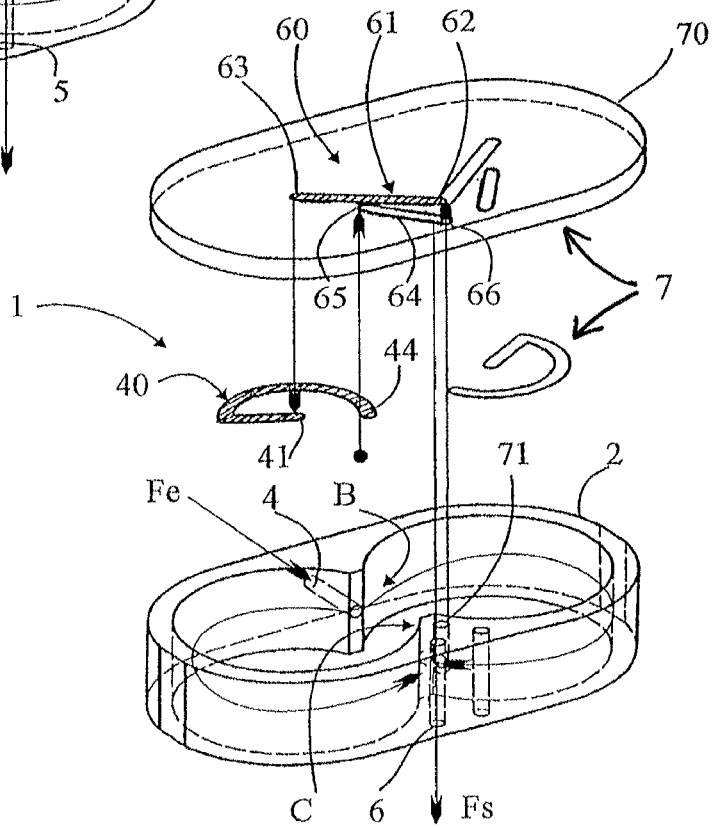

The operation of gear pump 1 according to the invention is described in reference to FIGS. 2A and 2B, which only illustrate the ducts, channels and circuits that form the means of commutation 7, for a given position of the toothed wheels 3.

FIG. 2A illustrates the distribution of fluid in a first distribution circuit (not illustrated) connected to one of the outlet ports 5. The incoming fluid Fe arrives in the suction chamber B of pump 1 via inlet port 4, and comes out of the discharge chamber C via port 71. It then enters the upstream channel 51 of the distribution circuit 50 via the fluid inlet 52, comes out via the fluid outlet 53 to enter at the upstream point 31 of buffer channel 30. The fluid fills the buffer channel 30 until the downstream point 34 of its angular sector 33 is aligned with the fluid inlet 55 of the downstream channel 54, thus allowing the discharge of the outgoing fluid Fs via the fluid outlet 56, then the outlet port 5 towards a first distribution circuit.

FIG. 2B illustrates the distribution of fluid in a second distribution circuit (not illustrated) connected to one of the outlet ports 6. The incoming fluid Fe arrives in the suction chamber B of pump 1 via inlet port 4, and comes out of the discharge chamber C via port 71. It then enters the upstream channel 61 of the distribution circuit 60 via the fluid inlet 62, comes out via the fluid outlet 63 to enter at the upstream point 41 of buffer channel 40. The fluid fills the buffer channel 40 until the downstream point 44 of its angular sector 43 is aligned with the fluid inlet 65 of the downstream channel 64, thus allowing the discharge of the outgoing fluid Fs via the fluid outlet 66, then the outlet port 6 towards a second distribution circuit.

Evidently, the fluid that comes out the discharge chamber C of pump 1 divides into two at the fluid inlet 52, 62 and is simultaneously distributed in the upstream channels 51, 61 of the distribution circuits 50, 60, and then in the buffer channels 30, 40, so that pump 1 remains primed and the flow rate of the outgoing fluid Fs is equal to the flow rate of the incoming fluid Fe divided by 2. The geometry and size of the distribution circuits 50, 60 and buffer channels 30, 40 are determined so that the volume of fluid they can contain approximately corresponds to the volume of fluid circulated by pump 1 over a full revolution of the toothed wheels 3.

Possibilities for Industrial Application:

Gear pump 1 according to the invention can be produced using any known manufacturing process and any material, appropriate and selected according to the applications, the nature of the fluid to be circulated, the size of the pump and the fluid flow rates. Since the means of commutation 7 require a sliding contact between the fixed support plate 70 and the revolving toothed wheels 3 to guarantee the circulation of the fluid and the commutation of the circuits with a minimum of leakage, the parts may be made from a material with a very low friction coefficient such as Teflon®.

This new technology of gear pump 1 may be used in a variety of fluid distribution processes, in which a fluid needs to be alternately distributed or circulated at least two utilization circuits based on at least one supply circuit. This specific requirement is particularly found in heat generators, used for heating, air-conditioning, tempering, etc in any technical field, and for which the calories and frigories must be recovered by at least one heat transfer fluid that circulates in a closed loop through at least one hot circuit and one cold circuit, these circuits being respectively linked to one hot heat exchanger and one cold heat exchanger.

FIGS. 3 to 6 schematically illustrate two examples of a fluid distribution process in hot and cold circuits for a heat generator using magneto-caloric material. These examples can evidently extend to any other type of heat generator.

This type of heat generator is known and will not be detailed here. It is represented by two active magneto-caloric elements AMR1 and AMR2 (AMR=Active Magnetic Regenerator) and one magnetic element CM arranged so as to generate a variation in magnetic field.

Figure 3:
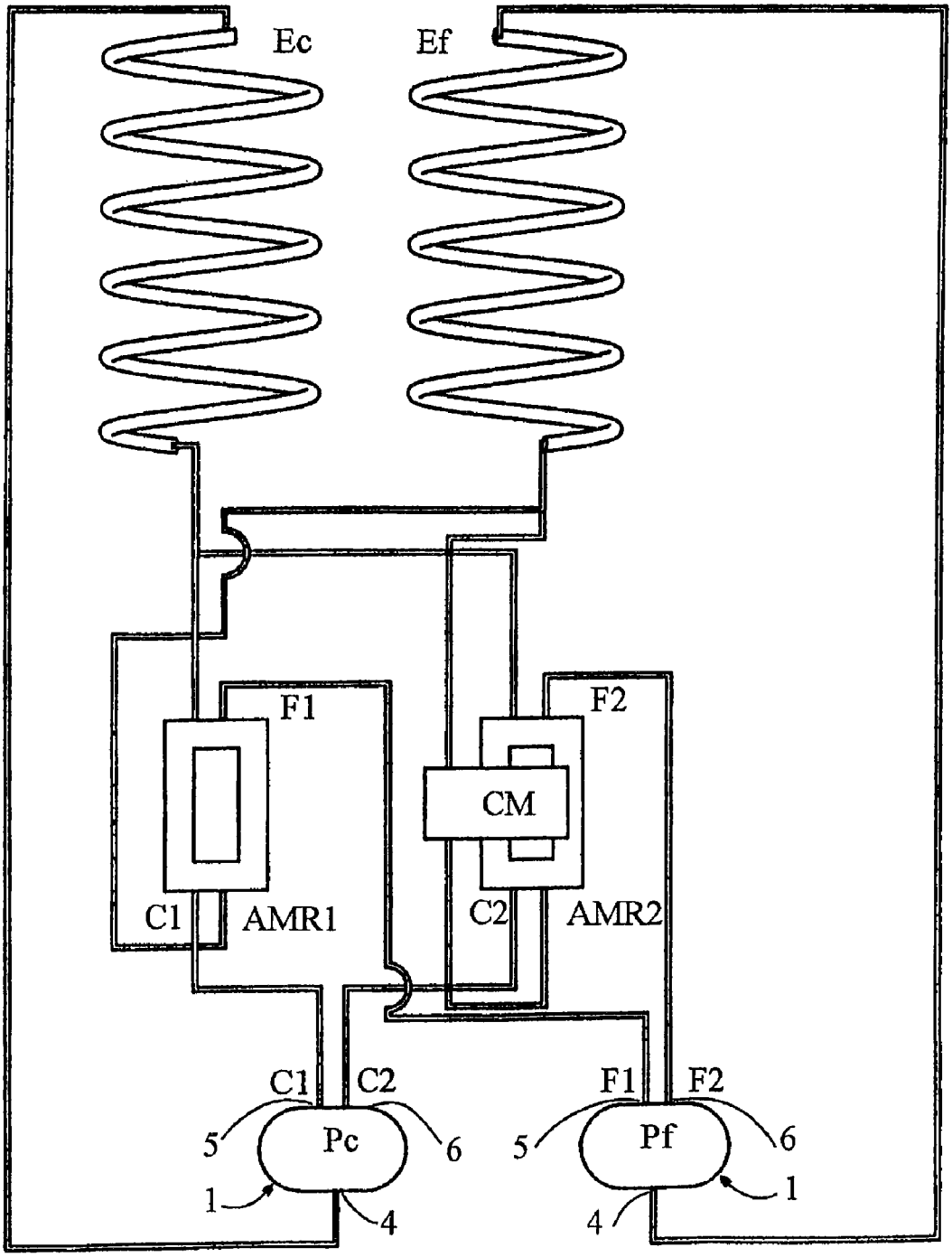
FIG. 3 is a schematic view illustrating a first example of application of the pump from FIG. 1, FIGS. 4A and 4B are schematic, simplified views of the example from FIG. 3 in a first and second commutation cycle.

In the first example illustrated in FIG. 3, each active element AMR1 and AMR2 is crossed by two distinct fluid circuits, one that corresponds to the hot circuit and the other that corresponds to the cold circuit, in which a hot heat transfer fluid and a cold heat transfer fluid circulate, respectively. In this configuration, the hot fluid in the hot circuit is circulated using a first gear pump 1 as defined above, named Pc, and the cold fluid is circulated in the cold circuit using a second gear pump 1, named Pf. Each circuit comprises a heat exchanger Ec, Ef, the outlet of which is connected to the inlet port 4 of the corresponding pump Pc, Pf. The outlet ports 5 and 6 of each pump Pc, Pf are each connected to an active element AMR1 and AMR2, and the outlets of these active elements AMR1 and AMR2 that correspond to the same circuit are connected together and at the inlet of the corresponding exchanger Ec, Ef.

Figure 4A:
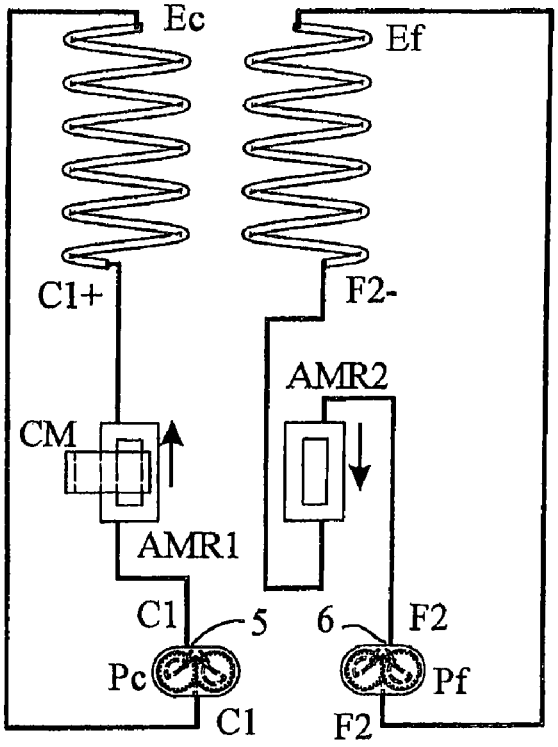
Figure 4B:
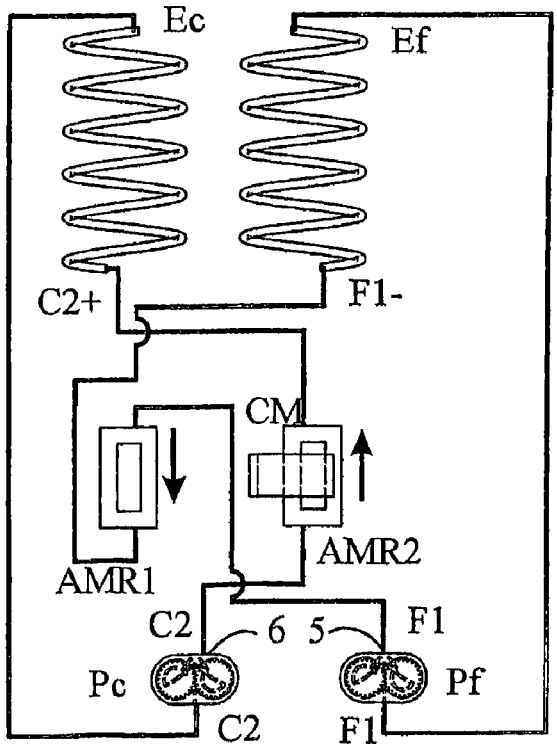

FIGS. 4A and 4B are simplified diagrams designed to understand how such an assembly operates.

In FIG. 4A, the magnetic element CM is opposite the active element AMR1 which heats up in the presence of the magnetic field or when the value of this field increases. In this active element AMR1, the hot heat transfer fluid C1 is circulated in order to recover the calories generated, while the cold heat transfer fluid F1 is stopped. A first commutation cycle of the pump Pc is used to distribute the fluid C1 via its outlet port 5. This fluid C1 enters the active element AMR1 and comes out of it at a higher temperature C1+ and then enters the exchanger Ec, which uses the calories. It comes out of it at a lower temperature C1 and goes back to the pump Pc.

In the meantime, the other active element AMR2, which is not subjected to the magnetic field or is subjected to a lower field value, cools down. In this active element AMR2, the cold heat transfer fluid F2 is circulated in order to recover the frigories generated, while the hot heat transfer fluid C2 is stopped. A first commutation cycle of the pump Pf is used to distribute the fluid F2 via its outlet port 6. This fluid F2 enters the active element AMR2 and comes out of it at a lower temperature F2− and then enters the exchanger Ef, which uses the frigories. It comes out of it at a higher temperature F2 and goes back to the pump Pf.

In FIG. 4B, the magnetic element CM has moved and is opposite the active element AMR2 which heats up in the presence of the magnetic field or when the value of this field increases. In this active element AMR2, the hot heat transfer fluid C2 is circulated in order to recover the calories generated, while the cold heat transfer fluid F2 is stopped. A second commutation cycle of the pump Pc is used to distribute the fluid C2 via its outlet port 6. This fluid C2 enters the active element AMR2 and comes out of it at a higher temperature C2+ and then enters the exchanger Ec, which uses the calories. It comes out of it at a lower temperature C2 and goes back to the pump Pc.

In the meantime, the other active element AMR1, which is no longer subjected to the magnetic field or is subjected to a lower field value, cools down. In this active element AMR1, the cold heat transfer fluid F1 is circulated in order to recover the frigories generated, while the hot heat transfer fluid C1 is stopped. A second commutation cycle of the pump Pf is used to distribute the fluid F1 via its outlet port 5. This fluid F1 enters the active element AMR1 and comes out of it at a lower temperature F1− and then enters the exchanger Ef, which uses the frigories. It comes out of it at a higher temperature F1 and goes back to the pump Pf.

Figure 5:
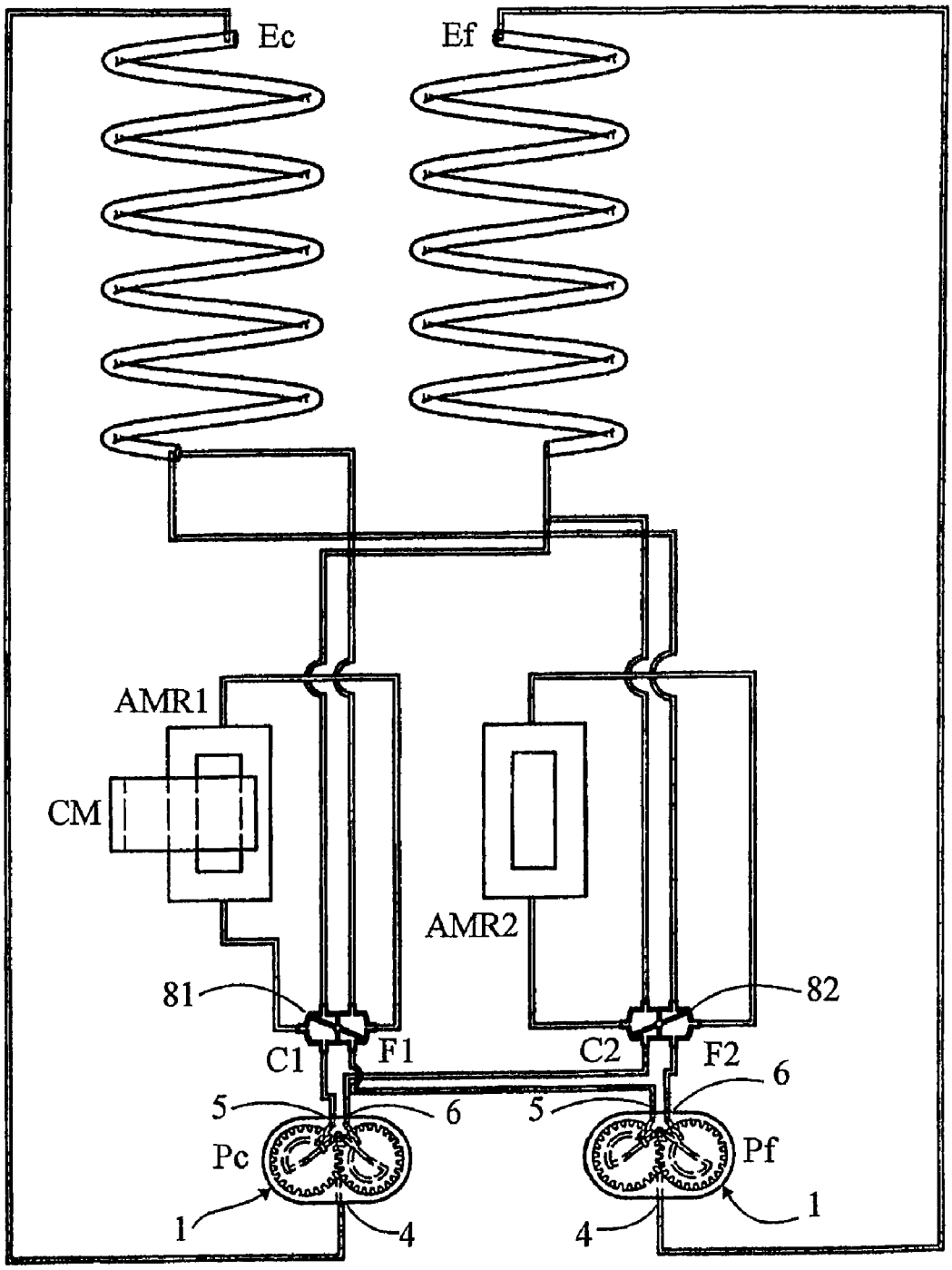
FIG. 5 is a schematic view illustrating a second example of application of the pump from FIG. 1, and FIGS. 6A and 6B are schematic, simplified views of the example from FIG. 5 in a first and second commutation cycle.

In the second example illustrated in FIG. 5, each active element AMR1 and AMR2 is crossed by the same fluid circuit, in which the same heat transfer fluid alternately circulates in a hot circuit and a cold circuit. In this configuration, the hot circuit uses a first gear pump 1 as defined above, named Pc, and the cold circuit uses a second gear pump 1, named Pf. Each circuit comprises a heat exchanger Ec, Ef, the outlet of which is connected to the inlet port 4 of the corresponding pump Pc, Pf. The outlet ports 5 and 6 of each pump Pc, Pf are connected to the inlet of the active elements AMR1 and AMR2 via an automatic check valve 81, 82. Similarly, the outlet of these active elements AMR1 and AMR2 is connected to the inlet of the exchangers Ec, Ef via the valve 81, 82. These valves 81, 82 comprise three inlets and three outlets, between which the fluid is directed by a central stop valve, the position of which is automatically controlled by the direction in which the fluid enters the valve. This valve 81, 82 allows the same fluid to be selectively circulated in the hot and cold circuits.

Figure 6A:
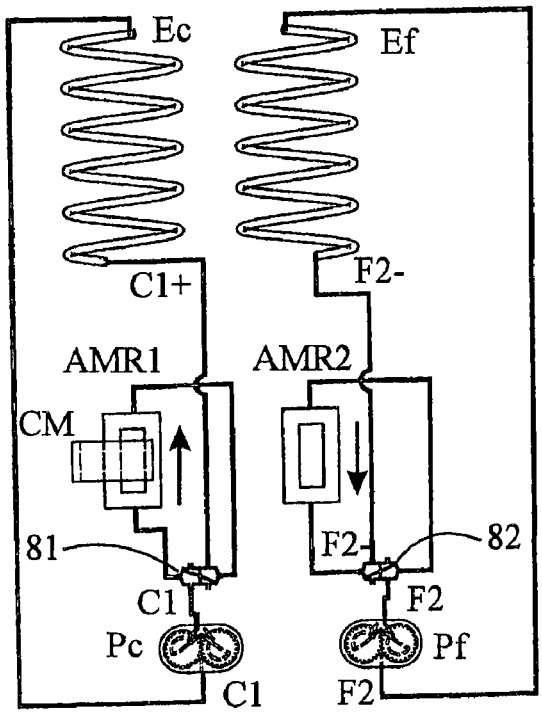
Figure 6B:
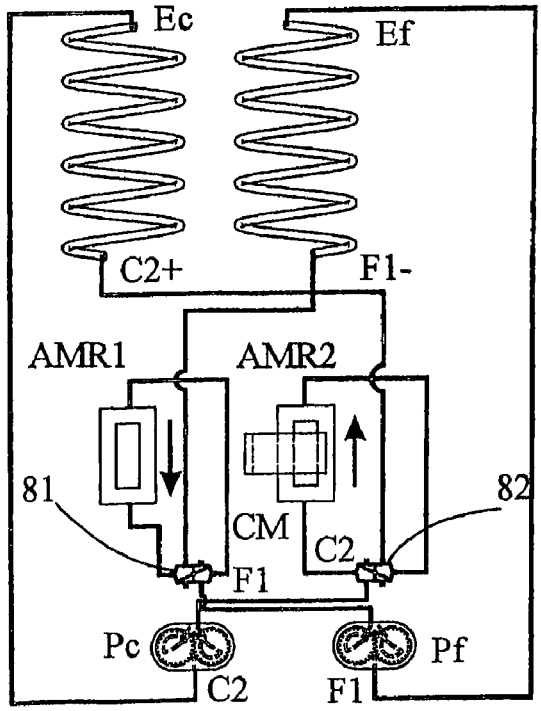

FIGS. 6A and 6B are simplified diagrams designed to understand how such an assembly operates.

In FIG. 6A, the magnetic element CM is opposite the active element AMR1 which heats up in the presence of the magnetic field or when the value of this field increases. A first commutation cycle of the pump Pc is used to distribute the fluid C1 via the outlet port 5. The valve 81 directs the fluid C1 into the active element AMR1 which comes out of the latter at a higher temperature C1+ and then enters the exchanger Ec via the valve 81. It comes out of the exchanger Ec at a lower temperature C1 and goes back to the pump Pc.

In the meantime, the other active element AMR2, which is not subjected to the magnetic field or is subjected to a lower field value, cools down. A first commutation cycle of the pump Pf is used to distribute the fluid F2 via the outlet port 6. The valve 82 directs the fluid F2 into the active element AMR2 which comes out of the latter at a lower temperature F2− and then enters the exchanger Ef via the valve 82. It comes out of it at a higher temperature F2 and goes back to the pump Pf.

In FIG. 6B, the magnetic element CM has moved and is opposite the active element AMR2 which heats up in the presence of the magnetic field or when the value of this field increases. A second commutation cycle of the pump Pc is used to distribute the fluid C2 via the outlet port 6. The valve 82 directs the fluid C2 into the active element AMR2 which comes out of the latter at a higher temperature C2+ and then enters the exchanger Ec via the valve 82. It comes out of the exchanger Ec at a lower temperature C2 and goes back to the pump Pc.

In the meantime, the other active element AMR1, which is not subjected to the magnetic field or is subjected to a lower field value, cools down. A second commutation cycle of the pump Pf is used to distribute the fluid F1 via the outlet port 5. The valve 81 directs the fluid F1 into the active element AMR1 which comes out of the latter at a lower temperature F1− and then enters the exchanger Ef via the valve 81. It comes out of it at a higher temperature F1 and goes back to the pump Pf.

In these examples that refer to a generator using magnetocaloric material, the rotation of the gear pumps Pc and Pf is synchronized with the movement of the magnetic means or with the variation in magnetic field. Similarly, the circulation of the fluid(s) in the hot and cold circuits is reversed inside the active elements AMR1 and AMR2. Any other configuration is possible.

The present invention is not limited to the examples of embodiment described but extends to any obvious modification and variation for a person skilled in the art without departing from the scope of protection, as defined by the annexed claims.

The invention claimed is:

1. A gear pump (1) comprising:

a pump housing (2) in which at least two meshed toothed wheels (3) are housed, with parallel axes of rotation (A), which delimit a suction chamber (B), on one side of a meshing zone, and a discharge chamber (C), on the other side of the meshing zone, the housing comprising at least one fluid inlet port (4) connected to at least one fluid supply circuit and linked with the suction chamber (B), and at least two fluid outlet ports (5, 6) connected to at least two fluid utilization circuits, the at least two outlet ports being linked with the discharge chamber (C), via an integrated means of commutation (7) arranged so as to alternately distribute the fluid to the utilization circuits according to a predetermined commutation cycle, each of the toothed wheels (3) comprising a buffer channel (30, 40), the buffer channels (30, 40) being arranged so as to alternately link the means of commutation (7) with the discharge chamber (C) and the outlet ports (5, 6) during rotation of the toothed wheels (3), each buffer channel (30, 40) comprising an upstream point (31, 41) and a downstream point (34, 44), wherein the means of commutation (7) comprise a support plate (70) mounted to the housing for the toothed wheels (3), the support plate (70) comprises at least two distribution circuits (50, 60) and each of the at least two distribution circuits (50, 60) comprises an upstream channel (51, 61) arranged so as to couple the discharge chamber (C) with the upstream point (31, 41) of a corresponding one of the buffer channels (30, 40) and a downstream channel (54, 64) arranged so as to couple the downstream point (34, 44) of the corresponding buffer channel with a corresponding one of the outlet ports (5, 6) when the inlet of the downstream channel (54, 64) is located opposite the buffer channel (30, 40).

2. The gear pump according to claim 1, wherein the predetermined commutation cycle is approximately equal to rotation of the toothed wheels (3) approximately over a maximum of a half a revolution of the tooth wheel (3).

3. The gear pump according to claim 1, wherein the distribution circuits (50, 60) and the buffer channels (30, 40) are formed by recesses located respectively on the support plate (70) and the toothed wheels (3).

4. The gear pump according to claim 1, wherein the buffer channels (30, 40) comprise at least one angular sector (33, 43) centered on the axis of rotation (A) of each toothed wheel (3), and offset one from another by a value of the angular sector.

5. The gear pump according to claim 4, wherein the angular sectors (33, 43) are equal to approximately 180° and are offset one from another by approximately 180°.

6. The gear pump according to claim 4, wherein the upstream point (31, 41) of each buffer channel (30, 40) merges with the axis of rotation (A) of the toothed wheel (3) and the downstream point (34, 44) is located within the angular sector (33, 43).

7. The gear pump according to claim 4, wherein the outlet (53, 63) of the upstream channel (51, 61) and the inlet (55, 65) of the downstream channel (54, 64) are separated form one another by an interval approximately equal to the radius of the angular sector (33, 43) of the buffer channel (30, 40).

8. The gear pump according to claim 1, wherein the upstream channels (51, 61) of the distribution circuit (50, 60) communicates via the same inlet (52, 62) connected to the discharge chamber (C).

9. A fluid distribution process for at least two utilization circuits based on at least one supply circuit, the fluid distribution process comprises at least one gear pump (1) which comprises a pump housing (2) housing at least two meshed toothed wheels (3) therein with parallel axes of rotation (A) which delimit a suction chamber (B), on one side of a meshing zone, and a discharge chamber (C), on the other side of the meshing zone, and at least one fluid inlet port (4) connected to at least one fluid supply circuit and linked with the suction chamber (B), the pump (1) further comprising at least two fluid outlet ports (5, 6) connected to at least two fluid utilization circuits, the at least two outlet ports being linked with the discharge chamber (C), the fluid distribution process comprising integrated means of commutation (7) arranged so as to alternately distribute the fluid to the utilization circuits according to a predetermined commutation cycle, each of the toothed wheels (3) comprising at least one buffer channel (30, 40), the buffer channels (30, 40) being arranged so as to alternately link the means of commutation 7 with the discharge chamber (C) and the outlet ports (5, 6) during rotation of the toothed wheels (3), each buffer channel (30, 40) comprising an upstream point (31, 41) and a downstream point (34, 44), wherein the means of commutation (7) comprise a support plate (70) mounted to the housing for the toothed wheels (3), the support plate (70) comprises at least two distribution circuits (50, 60) and each of the distribution circuits (50, 60) comprises an upstream channel (51, 61) arranged so as to couple the discharge chamber (C) with the upstream point (31, 41) of a corresponding buffer channel (30, 40), and a downstream channel (54, 64) arranged so as to couple the downstream point (34, 44)

of the corresponding buffer channel with a corresponding one of the outlet ports (5, 6) when the inlet of the downstream channel (54, 64) is located opposite the buffer channel (30, 40).

10. A fluid distribution process for one hot circuit and one cold circuit of a heat generator using the same heat transfer fluid that circulates in a closed loop, the fluid distribution process comprises at least first and second gear pumps (1) which each comprise a pump housing (2) housing at least two toothed wheels (3) therein with parallel axes of rotation (A) which delimit a suction chamber (B), on one side of a meshing zone, and a discharge chamber (C), on the other side of the meshing zone, the housing comprises at least one fluid inlet port (4) connected to at least one fluid supply circuit and linked with the suction chamber (B), and at least two fluid outlet ports (5, 6) connected to at least two fluid utilization circuits, the at least two outlet ports being linked with the discharge chamber (C), the first pump being dedicated to the hot circuit and the second pump to the cold circuit, the first and the second pumps each comprise integrated means of commutation (7) arranged so as to alternately circulate the fluid in the heat generator, depending on the production of calories and frigories, according to a predetermined commutation cycle, each of the at least the two toothed wheels (3) each comprising a buffer channel (30, 40), the buffer channels (30, 40) being arranged so as to alternately link the means of commutation (7) with the discharge chamber (C) and the outlet ports (5, 6) during rotation of the toothed wheels (3), each buffer channel (30, 40) comprising an upstream point (31, 41) and a downstream point (34, 44), wherein the means of commutation (7) comprise a support plate (70) mounted to the housing for the at least two toothed wheels (3), the support plate (70) comprises at least two distribution circuits (50, 60) and each of the distribution circuits (50, 60) comprises an upstream channel (51, 61) arranged so as to couple the discharge chamber (C) with the upstream point (31, 41) of a corresponding buffer channel (30, 40), and a downstream channel (54, 64) arranged so as to couple the downstream point (34, 44) of the buffer channel with a corresponding one of the outlet ports (5, 6) when the inlet of the downstream channel (54, 64) is located opposite the buffer channel (30, 40).

11. The fluid distribution process according to claim 10, further comprising the step of connecting each gear pump (1) to an automatic check valve (81, 82) arranged so as to selectively circulate the fluid in the hot circuit and the cold circuit.

12. A fluid distribution process for one hot circuit and one cold circuit of a heat generator using a first heat transfer fluid for the hot circuit and a second heat transfer fluid for the cold circuit, each fluid circulating in a closed loop, wherein first and second gear pumps (1) are accommodated within a pump housing (2) in which two toothed wheels (3) are housed, each having a parallel axis of rotation (A), which form a suction chamber (B), on one side of a meshing zone, and a discharge chamber (C), on the opposite side of the meshing zone, the housing comprising at least one fluid inlet port (4) connected to at least one fluid supply circuit and linked with the suction chamber (B);

at least two fluid outlet ports (5, 6) being connected to at least two fluid utilization circuits, the at least two outlet ports being linked with the discharge chamber (C), one of the first and second gear pumps being dedicated to the hot circuit and the other of the first and second gear pumps being dedicated to the cold circuit, each of the first and second gear pumps comprising integrated means of commutation (7) arranged so as to alternately circulate each fluid in the heat generator depending on the production of calories and frigories according to a predetermined commutation cycle, each of the two toothed wheels (3), of each of the first and the second gear pumps, comprising at least one buffer channel (30, 40), the buffer channels (30, 40) being arranged so as to alternately link the means of commutation (7) with the discharge chamber (C) and the outlet ports (5, 6) during rotation of the two toothed wheels (3), each buffer channel (30, 40) comprising an upstream point (31, 41) and a downstream point (34, 44), wherein the means of commutation (7) of each of the first and the second gear pumps comprise a support plate (70) mounted to the housing for the two toothed wheels (3), the support plate (70) comprises two distribution circuits (50, 60) and each of the two distribution circuits (50, 60) comprises an upstream channel (51, 61) arranged so as to couple the discharge chamber (C) with the upstream point (31, 41) of a corresponding buffer channel (30, 40), and a downstream channel (54, 64) arranged so as to couple the downstream point (34, 44) of the buffer channel with a corresponding one of the outlet ports (5, 6) when the inlet of the downstream channel (54, 64) is located opposite the buffer channel (30, 40).

13. The fluid distribution process according to claim 10, further comprising the step of using magneto-caloric elements (AMR1, AMR2) subjected to a variation in magnetic field (CM) in order to generate the calories and the frigories, and synchronizing the rotation of the gear pumps (1) with the variation in magnetic field (CM).

* * * * *